US006267320B1

(12) United States Patent
Gnan

(10) Patent No.: US 6,267,320 B1
(45) Date of Patent: Jul. 31, 2001

(54) UNROLL DEVICE

(75) Inventor: Gustav Alfons Gnan, Vilseck (DE)

(73) Assignee: BHS Corrugated Maschinen-und Anlagenbau GmbH, Weiherhammer (DE)

( * ) Notice: Subject to any disclaimer, the term of this patent is extended or adjusted under 35 U.S.C. 154(b) by 0 days.

(21) Appl. No.: 09/323,956

(22) Filed: Jun. 2, 1999

(30) Foreign Application Priority Data

Jun. 3, 1998 (DE) ..... 198 24 695

(51) Int. Cl.[7] ..... B65H 19/00

(52) U.S. Cl. ..... 242/559.1; 242/559.4; 242/563

(58) Field of Search ..... 242/559.1, 559.4, 242/399.1, 399.2, 596.1, 533.2, 563, 563.1

(56) References Cited

U.S. PATENT DOCUMENTS

| | | | | |
|---|---|---|---|---|
| 1,869,545 | * | 8/1932 | Crafts | 242/596.1 |
| 3,175,779 | * | 3/1965 | Grobman et al. | 242/559.1 |
| 4,460,135 | | 7/1984 | Hirakawa et al. . | |
| 4,586,673 | * | 5/1986 | Tokuno et al. | 242/559.4 |
| 4,895,314 | | 1/1990 | Thievessen . | |
| 4,930,713 | * | 6/1990 | Sato et al. | 242/559.1 |
| 5,320,296 | * | 6/1994 | Ozcariz et al. | 242/559.4 |
| 5,755,395 | | 5/1998 | Gnan . | |
| 5,863,175 | * | 1/1999 | Trefz | 242/559.1 |

FOREIGN PATENT DOCUMENTS

| | | |
|---|---|---|
| 86 29 994 | 11/1987 | (DE) . |
| 40 08 897 | 9/1991 | (DE) . |
| 42 24 309 | 1/1994 | (DE) . |
| 0 387 365 | 9/1990 | (EP) . |
| 0 629 574 | 12/1994 | (EP) . |
| 0 700 854 | 3/1996 | (EP) . |
| 1 600 070 | 10/1981 | (GB) . |

* cited by examiner

*Primary Examiner*—John M. Jillions
(74) *Attorney, Agent, or Firm*—Browdy and Neimark

(57) ABSTRACT

In an unroll device provision is made for at least one unroll stand which comprises two lugs lodged in bearing supports. The bearing levers are horizontally movable individually. Furthermore, a supporting shaft is run on the bearing supports of an unroll stand in such a way that it can be shifted parallel allel to itself, but also out of its base position in a horizontal plane.

7 Claims, 4 Drawing Sheets

UNROLL DEVICE

BACKGROUND OF THE INVENTION

1. Field of the Invention

The invention relates to an unroll device with at least one unroll stand, comprising a machine frame, which has two bearing stands spaced apart; bearing supports, which are guided substantially horizontally movably on the bearing stands; shifting drives acting on the bearing supports; a supporting shaft, the ends of which are run on the bearing supports; lugs, which are guided on the supporting shaft non-rotatably relative thereto, but displaceably in their longitudinal direction; centering pivots for holding a reel, which are mounted on the lugs and define an unrolling axis; and at least one lifting drive coupled to the supporting shaft.

2. Background Art

Unroll devices of the generic type are known for instance from EP 0 629 574 B1. In this case the supporting shafts are guided via a stationary radial cam such that the reel unrolling axis, which is defined by the centering pivots, is moved in a vertical plane over a stationary rest taking up the paper reel on the ground so that paper reels of varying thickness, the center line of which differs correspondingly in height above the rest, can be seized reliably. In this known unroll device, the paper reel must be oriented on the rest, i.e. relative to the ground, such that the center line of the reel is parallel to the unrolling axis of the unroll device. Corresponding orientation of the center line of a paper reel takes place by the aid of a device as illustrated and described in U.S. Pat. No. 5,755,395.

U.S. Pat. No. 4,930,713 teaches another unroll device, in which the supporting shaft carrying the lugs is guided via eccentric cam plates. In this way, it is also possible to move the centering pivots of the lugs in a vertical plane so that paper reels of varying thickness can be seized reliably.

DE G 86 29 994 U1 teaches an unroll device in which the supporting shaft, which carries the lugs, is lodged in a parallel steering system so that the centering pivots are forcibly guided in a vertical plane.

SUMMARY OF THE INVENTION

It is an object of the invention to embody an unroll device of the generic type such that orientation of the reel to be picked up is not necessary prior to it being lifted by the unroll device.

According to the invention, this object is attained by the features wherein the supporting shaft is run on the bearing supports such that its central longitudinal axis is not only displaceable parallel to itself, but is also pivotal about a base position substantially in a horizontal plane; and wherein the shifting drives can be operated individually. Due to the fact that the supporting shaft and thus the unrolling axis are pivotal by some degrees not only parallel to themselves, but also relative to themselves in the horizontal plane, to which end the shifting drives of the bearing supports can be trigered independently from each other, i.e. due to the fact that the bearing supports of an unroll stand are movable relative to each other, the centering pivots of an unroll stand can be moved into a position in which the unrolling axis they define is in alignment with the center line of the paper reel lying before the device.

Further features, advantages and details of the invention will become apparent from the ensuing description of two exemplary embodiments, taken in conjunction with the drawing.

DESCRIPTION OF THE PREFERRED EMBODIMENTS

Figure 1:
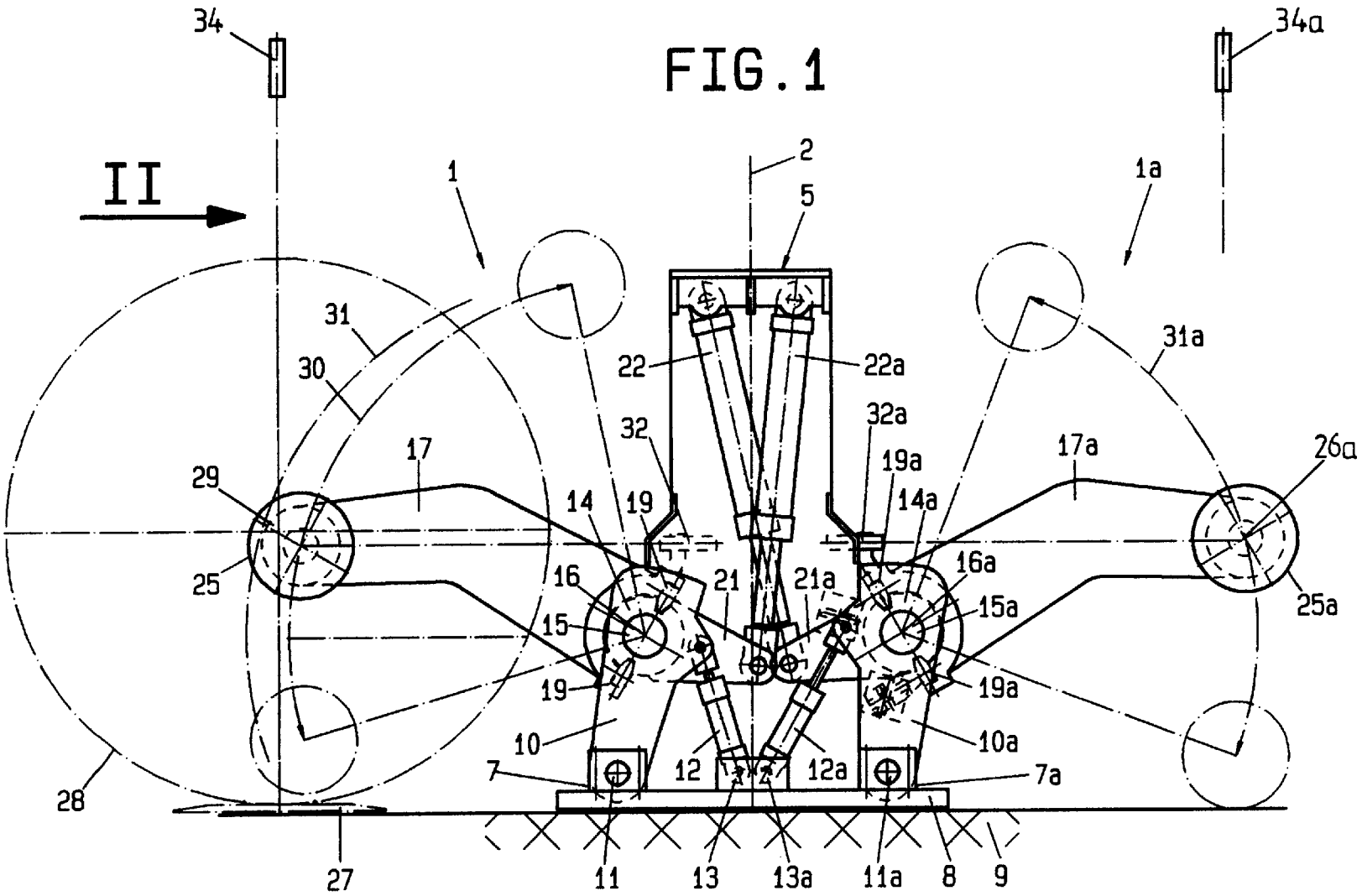
FIG. 1 is a lateral view, partially broken away, of an unroll device corresponding to the arrow in FIG. 2.

The embodiments seen in FIGS. 1 to 4 of an unroll device are largely identical. The ensuing description therefore applies to both embodiments, provided differences are not explicitly emphasized. Components which are substantially identical in both embodiments and differ only in minor constructional details not relevant to the invention nevertheless have the same reference numerals.

Figure 2:
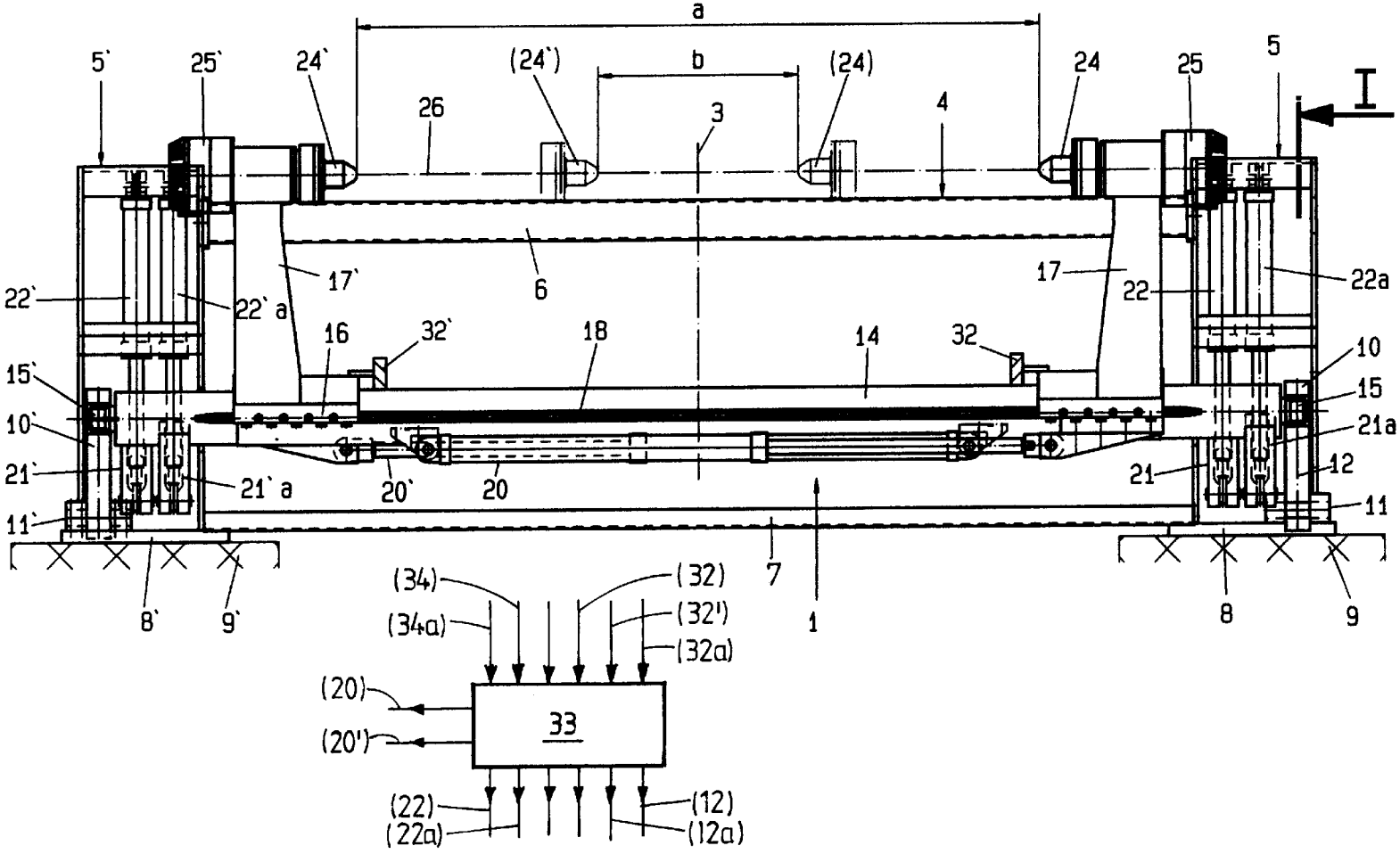
FIG. 2 is a longitudinal view of the unroll device corresponding to the arrow II in FIG. 1.
Figure 3:
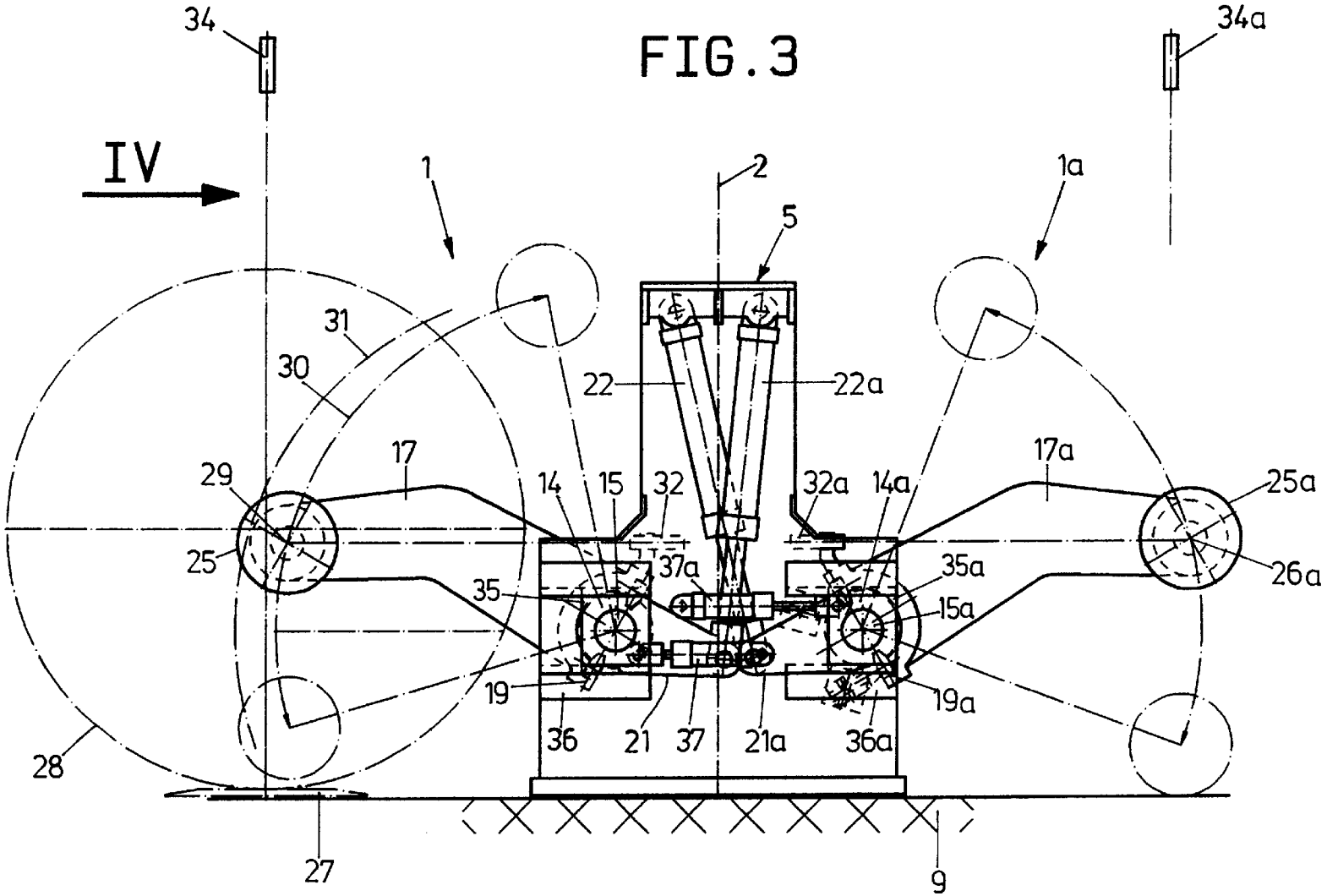
FIG. 3 is a lateral view of a modified embodiment of an unroll device corresponding to the arrow III in FIG. 4.
Figure 4:
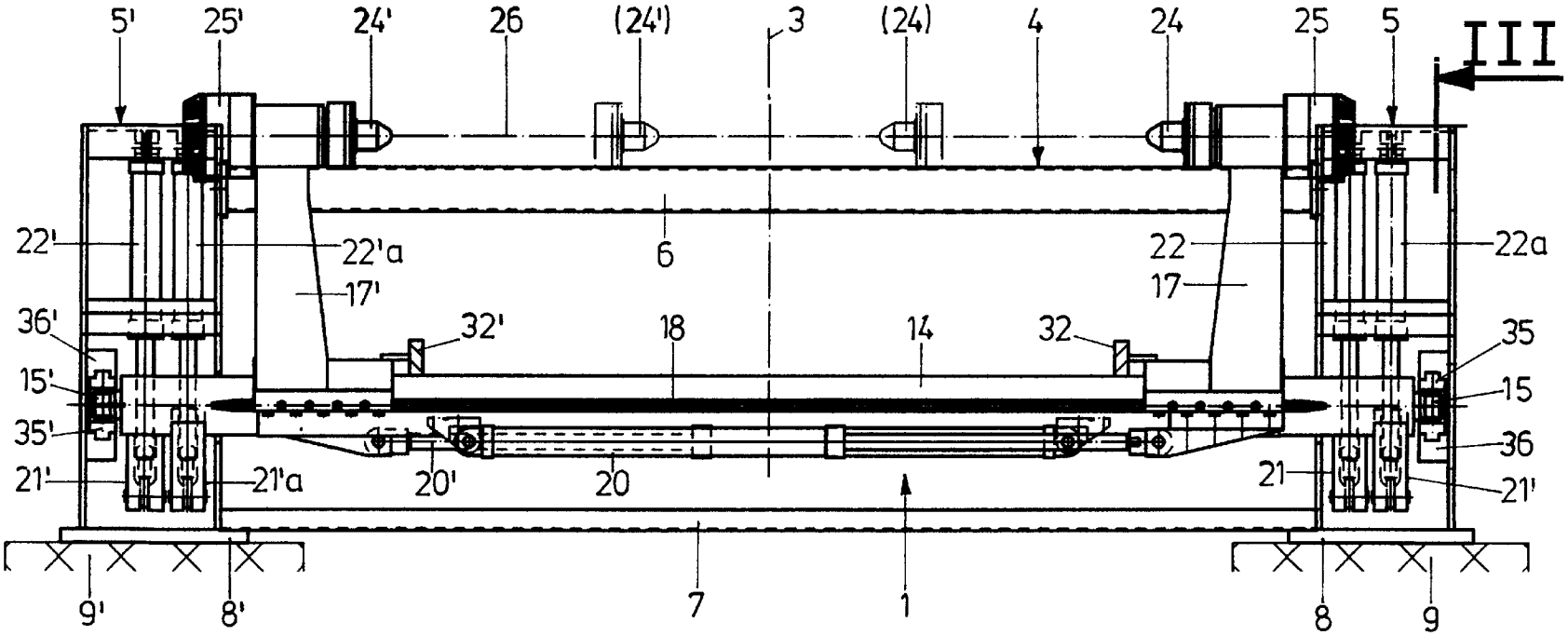
FIG. 4 is a longitudinal view of the modified embodiment of an unroll device corresponding to the arrow IV in FIG. 3.

As seen in FIG. 1 and FIG. 3, each unroll device illustrated comprises two unroll stands 1, 1*a* disposed in mirror symmetry to a vertical center plane 2 which is parallel to the plane of the drawing according to FIGS. 2 and 4. Due to the mirror symmetry of these stands 1, 1*a*, the components allocated to the stand 1 on the left in FIGS. 1 and 3 will be denoted in the following by a simple reference numeral, and the components allocated to the stand 1*a* on the right in FIGS. 1 and 3 will be denoted by the same reference numeral with the letter "a" added, there being no need of renewed description. As further seen in FIGS. 2 and 4, the two unroll stands 1 and 1*a* themselves are again constructed in mirror symmetry to a vertical center plane 3 which is parallel to the plane of the drawing of FIGS. 1 and 3. This is why the components on the right in FIGS. 2 and 4 and also visible in FIGS. 1 and 3 are denoted by reference numerals without a prime, whereas the components on the left in FIGS. 2 and 4 are denoted by the same reference numeral, however with an additional prime, there being no need of renewed description.

The unroll device comprises a machine frame 4 with two bearing stands 5, 5' which are disposed at a distance from each other and are rigidly joined to each other by means of an upper longitudinal beam 6 and lower longitudinal braces 7, 7*a*. The stands 5, 5' are supported by base plates 8, 8' on ground foundations 9, 9'.

In the embodiment according to FIGS. 1 and 2, a bearing lever 10, 10*a* and 10', respectively, is lodged as a bearing support on each base plate 8, 8' for each unroll stand 1, 1*a* in a manner to be pivotal in a stationary base bearing 11, 11*a*, 11' disposed on the respective base plate 8, 8'. A pivoting drive 12, 12*a* acts as a shifting drive on the respective bearing lever 10, 10*a*, 10'; the pivoting drive 12, 12*a* is a piston-cylinder drive bilaterally actuated by pressurized fluid and it is articulated stationarily, but pivotally to a ground bearing 13, 13*a* mounted on the respective base plate 8, 8'.

The two ends of a supporting shaft 14, 14*a* are run by bearings 15, 15' and 15*a*, respectively, on the bearing levers 10, 10' of the unroll stand 1 and correspondingly in the bearing levers 10*a* of the other unroll stand 1*a*. These bearings 15, 15' and 15*a* are designed such that it is possible not only to move the supporting shafts 14, 14*a* so that their central longitudinal axes 16, 16*a* are shifted parallel to themselves and to the vertical center plane 2, but also to pivot or deflect them relative to their longitudinal direction.

Consequently, they can be deflected in such a way that their central longitudinal axes 16, 16*a* are moved substantially in the horizontal out of a position parallel to the vertical center plane 2. To this end, the bearings 15, 15' and 15*a*, respectively, are for instance spherical bearings, which are supported in the bearing levers 10, 10' and 10*a* to be pivotally movable and displaceable to a certain extent in the direction of the respective axis 16 and 16*a*, respectively. The bearings 15, 15' and 15*a* are located at the upper ends, opposite the base bearings 11, 11*a* and 11', of the bearing levers 10, 10*a* and 10'.

On each supporting shaft 14, 14*a*, two lugs 17, 17' and 17*a* are mounted at a distance from each other and non-rotatably relative to the supporting shaft 14, 14*a*. To this end, the supporting shafts 14, 14*a* have outer guiding grooves 18, which are parallel to their central longitudinal axis 16, 16*a* and with which engage guiding projections 19, 19*a* formed on the respective lug 17, 17', 17*a* so that the lugs 17, 17*a*, 17' are mounted on the respective supporting shaft 14, 14*a* non-rotatably, but displaceably in the lengthwise direction thereof. The lengthwise displacement or lengthwise adjustment relative to each other in pairs, of the lugs 17, 17' and 17*a*, which are disposed on a supporting shaft 14 and 14*a*, is effected by means of two adjustment drives 20, 20', which are likewise piston-cylinder drives actuated by pressurized fluid, one end of which is articulated to the supporting arm 17 and 17' and the other end to the supporting shaft 14 and 14', respectively, as seen in particular in FIGS. 2 and 4.

In the vicinity of the respective ends of the supporting shafts 14, 14*a*, i.e. neighboring the bearings 15, 15*a* and 15', pivoting arms 21, 21*a* and 21', 21'*a* are mounted on the support shafts 14, 14*a*. Lifting drives 22, 22*a* act on the free ends of these pivoting arms 21, 21*a* and 21', 21'*a*, which are also piston-cylinder drives actuated by pressurized fluid, which are articulated in the upper portion of the bearing stands 5, 5' on the one hand and to the free ends, facing each other, of the pivoting arms 21, 21*a* and 21', 21'*a* on the other hand, as seen in FIGS. 1 to 4.

Mounted on the free ends of the lugs 17, 17' and 17*a* turned away from the respective supporting shaft 14, 14*a* are centering pivots 24, 24', which are directed towards each other in each unroll stand 1 and 1*a*. These centering pivots 24, 24' can be driven and braked by unrolling drives 25, 25', 25*a*, which are mounted on the respective lug 17, 17' and 17*a* and can also work as brakes. Due to the described pivotability of the axes 16, 16*a*, the unrolling axes 26 and 26*a*, which connect a pair of centering pivots 24, 24', are not only displaceable parallel to themselves, but also deflectable out of their position.

The pivoting drives 12 and 12*a* of each unroll stand 1 and 1*a* can be actuated and triggered individually so that the motions they effect are independent of each other.

The following is a description of the working of the unroll device, proceeding from the fact that a paper reel 28, outlined by dashes, is deposited on a rest 27 and is intended to be picked up, centered and pivoted upwards for unrolling.

The pivoting arms 21, 21' are pivoted by the lifting drives 22, 22' so that the centering pivots 24, 24' move into a position in alignment with the center line 29 of reel 28. When the unrolling axis 26 is not parallel to the center line 29, i.e. not parallel to the vertical center plane 2, then the bearing levers 10, 10' are pivoted by correspondingly varying triggering of the pivoting drives 12 so that the unrolling axis 26 moves into a position parallel to the center line 29 of the paper reel 28. FIG. 1 roughly outlines to which extent the bearing levers 10, 10' and 10*a* of each unroll stand 1 and 1*a* can be pivoted relative to each other with the corresponding central longitudinal axis 16 and 16*a* of the respective supporting shaft 14 and 14*a* and thus the unrolling axis 26 and 26*a* being pivoted correspondingly. By simultaneous pivoting of the bearing levers 10, 10' and 10*a* in an opposite direction, varying, non-parallel paths of the center line 29 of the reel 28 relative to the center plane 2 can be balanced as illustrated by the pivoting paths 30 and 31 for the center line of the reel 28 which are roughly outlined for the unroll stand 1 in FIG. 1. When the unrolling axis 26 defined by the centering pivots 24 and 24' is in alignment with the center line 29 of the reel 28, then the adjustment drives 20 are triggered so that the centering pivots 24, 24' engage concentrically in the paper reel 28. Then orientation of the paper reel 28 takes place by the pivoting drives 12, 12' being triggered correspondingly so that the center line 29 moves into a horizontal position parallel to the center plane 2, i.e. the desired base position. Subsequently, it is pivoted upwards by actuation of the lifting drives 22, 22' into a position suitable for unrolling. Fundamentally, only a single lifting drive 22 and 22*a* or 22' and 22'*a* is needed for each supporting shaft 14, 14*a*; in the embodiments shown, two lifting drives 22, 22' and 22*a*, 22'*a* are provided for each supporting shaft 14, 14*a* solely so as to avoid that substantial torsions develop in the respective supporting shaft 14 and 14*a*.

FIG. 2 shows the greatest possible length a of a paper reel 28 to be picked up and the smallest possible length b of a paper reel 28 for the unroll stand 1. Further, the entire pivoting range of the lugs 17, 17' is outlined on the left in FIG. 1 for the pivoting path 30 with the supporting shaft 14 shifted as far as possible towards the center plane 2, whereas the greatest possible pivoting range of the lugs 17*a* is shown on the right in FIG. 1 for the pivoting path 31*a* of the unroll stand 1*a* with the supporting shaft 14*a* moved as far as possible away from the center plane 2. Triggering the various drives actuated by pressurized fluid, i.e. the pivoting drives 12 and 12*a*, the adjustment drives 20, 20*a* and the lifting drives 22, 22', 22*a*, 22'*a*, takes place in a manner known per se, for instance via solenoid valves which are again triggered by a central control system 33 only roughly outlined. This central control system 33 receives signals from transmitters 32, 32', 32*a*, which are only roughly outlined and which detect the actual position of the paper reel 28, in concrete terms its distance from the transmitters and thus from the vertical center plane 2. Provided above the paper reel 28 are transmitters 34 and 34*a*, respectively, which detect the distance of the paper reel 28 from the respective upper transmitter 34 and 34*a* and thus the distance 29 over the rest 27. The diameter of the reel 28 is detected by these transmitters 34 and 34*a*. As opposed to this, the transmitters 32, 32' and 32*a* serve to detect the oblique position of the center line 29 relative to the vertical center plane 2. Such an oblique position may for example amount to as much as +/−60 mm which can be balanced. Moreover, irregular web tensions can be compensated by the pivoting drives 12 and 12*a* being correspondingly triggered.

In the embodiment according to FIGS. 3 and 4, the supporting shafts 14, 14*a* are run by means of the bearings 15, 15', 15*a* on bear 35*a*, which are displaceable horizontally and crosswise to the vertical center plane 2 and which are guided for displacement on bars 36, 36', 36*a* mounted on the bearing stands 5, 5'. Since in this embodiment, the bearing supports 35, 35', 35*a* make exclusively horizontal motions, the shifting drives 37, 37*a* also engage horizontally, i.e. they are articulated to the bearing supports 35, 35*a* on the one hand and, approximately at the same height, to the bearing stand 5 on the other hand. Also for this design, FIG. 3 shows the position of the respective bearing support 35 and 35*a* retracted inwards as far as possible and extended outwards as far as possible, from which also results the horizontal pivotability of the unrolling axis 26 and 26*a*.

What is claimed is:

1. An unroll device with at least one unroll stand (1, 1*a*), comprising a machine frame (4), which has two bearing stands (5, 5') spaced apart;

bearing supports (10, 10', 10*a*; 35, 35', 35*a*), which are guided substantially horizontally movably on the bearing stands (5, 5');

shifting drives (12, 12*a*; 37, 37*a*) acting on the bearing supports (10, 10', 10*a*; 35, 35', 35*a*);

a supporting shaft (14, 14*a*), which has a central longitudinal axis (16, 16*a*), and the ends of which are run on the bearing supports (10, 10', 10*a*; 35, 35', 35*a*);

lugs (17, 17', 17*a*), which are guided on the supporting shaft (14, 14*a*) non-rotatably relative thereto, but displaceably in the direction of the central longitudinal axis (16, 16*a*);

centering pivots (24, 24', 24*a*) for holding a reel (28), which are mounted on the lugs (17, 17', 17*a*) and define an unrolling axis (26, 26*a*); and at least one lifting drive (22, 22', 22*a*, 22'*a*) coupled to the supporting shaft (14, 14*a*);

wherein the supporting shaft (14, 14*a*) is run on the bearing supports (10, 10', 10*a*; 35, 35', 35*a*) such that its central longitudinal axis (16, 16*a*) is not only displaceable parallel to itself, but is also pivotal about a base position substantially in a horizontal plane; and wherein the shifting drives (12, 12'; 37, 37') are individually operable.

2. An unroll device according to claim 1, wherein the supporting shaft (14, 14*a*) is run on the bearing supports(10, 10', 10*a*; 35, 35', 35*a*) by means of spherical bearings (15, 15', 15*a*).

3. An unroll device according to claim 1, wherein clearance in the direction of the central longitudinal axis (16, 16*a*) exists between the supporting shaft (14, 14*a*) and the bearing supports (10, 10', 10*a*; 35, 35', 35*a*).

4. An unroll device according to claim 1, wherein the bearing supports are bearing levers (10, 10', 10*a*) pivotally articulated to the bearing stands (5, 5').

5. An unroll device according to claim 1, wherein the bearing supports (35, 35', 35*a*) are formed substantially horizontally displaceably on the bearing stand (5, 5').

6. An unroll device according to claim 1, wherein at least one transmitter (34, 34*a*) is provided for detecting the distance of a central longitudinal axis (29) of the reel (28) from the transmitter (34, 34*a*).

7. An unroll device according to claim 1, wherein transmitters (32, 32', 32*a*) are provided for detecting an oblique position of the reel (28).

* * * * *